US006213524B1

(12) United States Patent
Bree et al.

(10) Patent No.: US 6,213,524 B1
(45) Date of Patent: Apr. 10, 2001

(54) ROTARY LINK DEADBOLT LOCKING ACTUATOR AND METHOD

(75) Inventors: Gary David Bree, Clarkston; Mark Michael Berklich, Leonard; Lloyd Walker Rogers, Jr., Shelby Township, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 08/076,722

(22) Filed: Jun. 14, 1993

(51) Int. Cl.[7] ..... E05C 3/06

(52) U.S. Cl. ..... 292/201; 292/216; 70/277; 70/280

(58) Field of Search ..... 292/DIG. 65, 201, 292/336.3, 216, 199, DIG. 62; 70/277, 280

(56) References Cited

U.S. PATENT DOCUMENTS 4,395,064 * 7/1983 Bellot et al. ..... 292/201
4,518,181 * 5/1985 Yamada ..... 292/201
5,035,453 * 7/1991 Fukumoto et al. ..... 292/336.3
5,052,731 * 10/1991 Hayakawa et al. ..... 292/336.3
5,074,603 * 12/1991 Brackmann ..... 292/DIG. 65
5,169,186 * 12/1992 Fukumoto et al. ..... 292/201
5,240,296 * 8/1993 Kobayashi ..... 292/336.3

FOREIGN PATENT DOCUMENTS

0159238 * 10/1985 (EP) ..... 292/201

* cited by examiner

*Primary Examiner*—Darnell Boucher
(74) *Attorney, Agent, or Firm*—Patrick M. Griffin

(57) ABSTRACT

A deadbolt locking actuator includes a housing mounting a reversible motor. A worm is fitted on an output shaft of the motor and meshed with a worm gear. A rotary arm is provided outside of the housing and coupled to the worm gear. A pin on the rotary arm is received in an elongated slot of a link connected to a manual locking lever of a door latch. A control circuit operates the drive unit and link between deadbolt and non-deadbolt positions.

6 Claims, 2 Drawing Sheets

ROTARY LINK DEADBOLT LOCKING ACTUATOR AND METHOD

BACKGROUND OF THE INVENTION

1. Field of the Invention

The present invention relates generally to automotive door locks, and in particular is concerned with a deadbolt locking actuator for a power door latch.

2. Description of the Related Art

Power door lock systems for vehicles are well-known. For additional security, some vehicles utilize a "deadbolt locking system" to prevent unwanted unlocking of a power door latch by moving a manual lock operator. Only when a predetermined signal (e.g., a key inserted and rotated in a key cylinder) is generated in such a system will a deadbolt actuator permit a door latch to be unlocked.

SUMMARY OF THE INVENTION

The present invention includes a deadbolt locking actuator for an automotive door latch. The deadbolt actuator is used in a locking system to prevent the unlocking of a door latch when a key has not been inserted and rotated in a selected door, e.g., the driver door. The locking system may include deadbolt actuators for all door latches.

In a preferred embodiment, a deadbolt locking actuator includes a housing mounting a reversible motor. A worm is fitted on an output shaft of the motor and meshed with a worm gear. A rotary arm is provided outside of the housing and coupled to the worm gear, A pin on the rotary arm is received in an elongated slot of a link connected to a manual locking lever of a door latch. A control circuit operates the drive unit and link between deadbolt and non-deadbolt positions.

DETAILED DESCRIPTION OF THE PREFERRED EMBODIMENT

Figure 1:
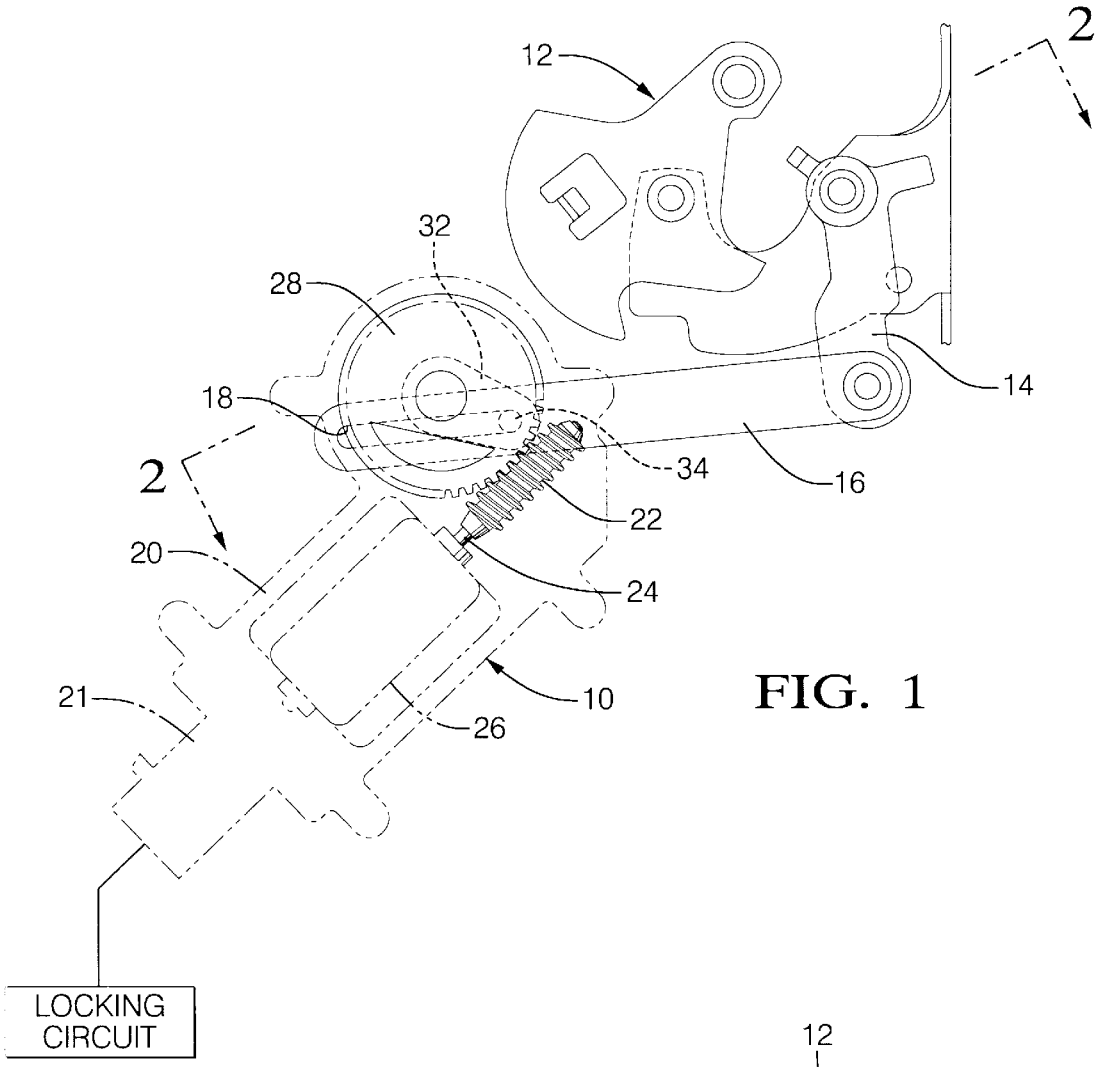
FIG. 1 is a schematic side view of a preferred embodiment of a deadbolt locking actuator coupled to a partially illustrated door latch by a link, wherein an upper portion of the actuator housing has been removed to illustrate a drive unit.
Figure 2:
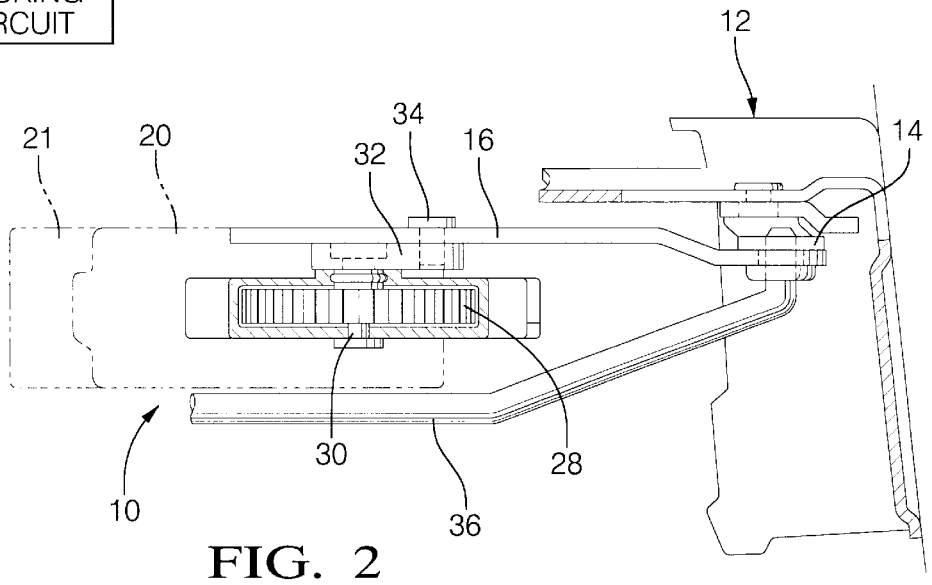
FIG. 2 is a top view of the deadbolt locking actuator and door latch of FIG. 1.

A deadbolt locking actuator is indicated generally at 10 in FIGS. 1–4. The actuator 10 is connected to a conventional door latch 12, which is only partially illustrated in the figures. Examples of suitable conventional door latches are found in U.S. Pat. Nos. 5,054,827, 5,046,769, and 4,969,673, all of which are assigned to the present assignee and hereby incorporated by reference.

The door latch 12 includes a manual locking lever 14 which rotates between unlocked and locked positions as described below. The manual locking lever 14 is conventionally coupled to an inside garnish button, lever, or other inside lock operator, none of which are illustrated in the figures. A conventional integral actuator (not illustrated) is combined with the door latch 12 to operate a power lock actuator arm (not illustrated) in a well-known manner.

A link 16 is pivotally connected at a first end to the manual locking lever 14. At the opposite end, the link 16 includes an elongated slot 18. As described below, the link 16 is rotated by the actuator 10 to move the manual locking lever 14 between unlocked and locked positions.

The actuator 10 includes a housing 20 mounting a drive unit powered via an electrical connector (not illustrated) positioned in a neck 21 of the housing 20. In FIG. 1, an upper portion of the housing 20 has been removed for clarity of illustration. A worm 22 is fitted on an output shaft 24 of a reversible electric motor 26. The worm 22 is meshed with a worm gear 28 rotatably mounted on a shaft 30. A rotary arm 32 having an upstanding pin 34 is provided outside of the housing 20 and coupled to the worm gear 28. When the motor 26 is operated, the rotary arm 32 rotates with the worm gear 28. The pin 34 is received in the slot 18 of the link 16. A bracket 36 connects the housing 20 to the door latch 12.

Figure 3:
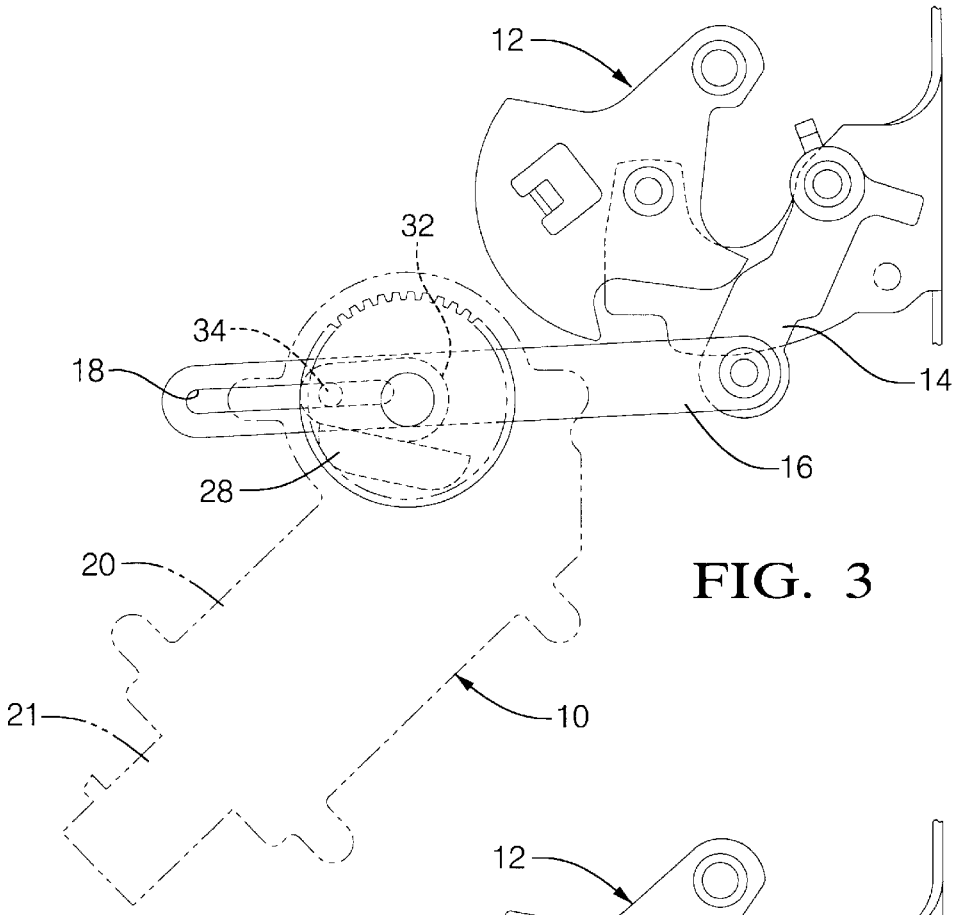
FIG. 3 is a schematic side view of the deadbolt locking actuator in a non-deadbolt position and the manual locking lever in an unlocked position.

Preferably, the actuator 10 is controlled by an automotive locking circuit 3a including a switch activated by a key cylinder (not illustrated). In FIG. 3, a schematic illustration of the actuator 10 includes the upper portion of the housing 20 (which was removed in FIG. 1) illustrating a stop 40 mounted on an outer surface of the housing 20. The stop 40 is positioned to engage the rotary arm 32. The actuator 10 is shown in a non-deadbolt state in FIG. 3 and the manual locking lever 14 is rotated clockwise from its position of FIG. 1 to an unlatched position. In this state, the manual locking lever 14 is free to move between the locked and unlocked positions. As the lever 14 is moved, the link 16 is permitted to follow since pin 34 travels in slot 18.

Figure 4:
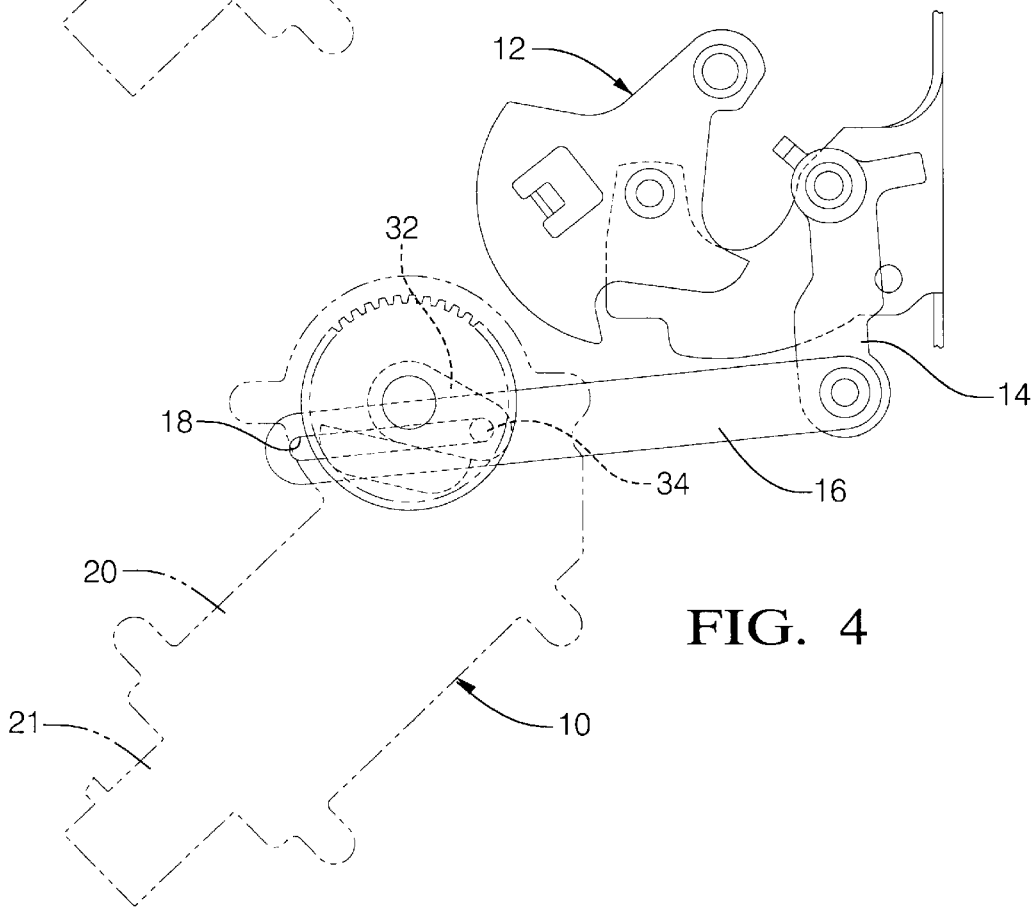
FIG. 4 is a schematic side view of the deadbolt locking actuator in a deadbolt position and the manual locking lever in a locked position.

To place the actuator 10 in a deadbolt state, an operator inserts and rotates a key in a driver door key cylinder to close a deadbolt switch, thereby energizing a relay module to power an actuator 10 at each door to the deadbolt state. The motor 26 is powered so that the worm 22 on the output shaft 24 turns the worm gear 28 and rotates the rotary arm 32 clockwise to engage the stop 40 as illustrated in FIG. 4. The manual locking lever 14 is rotated counterclockwise and blocked in the locked position by the position of the link 16. The lever 14 cannot be moved from this locked position since the pin 34 cannot travel in the slot 18.

When the driver door key is reinserted and rotated, the driver door is mechanically undeadbolted. The deadbolt switch is opened, which signals the relay module to power the other deadbolt actuators 10 out of the deadbolt state. The motor 26 is powered in the opposite direction to rotate the rotary arm 32 counterclockwise back to the nondeadbolt position illustrated in FIG. 3. The manual locking lever 16 is now free again to move from the locked to unlocked position due to the pin 34 movement in the slot 18.

Although the present invention has been described with reference to a preferred embodiment, workers skilled in the art will recognize that changes may be made in form and detail without departing from the spirit and scope of the invention.

The embodiments of the invention in which an exclusive property or privilege is claimed are defined as follows:

1. A locking actuator system for an automotive door latch having a manual locking lever movable between locked and unlocked positions, comprising:

(a) a housing;

(b) a reversible electric motor mounted in the housing and having an output shaft;

(c) a worm mounted on the output shaft;

(d) a worm gear, mounted in the housing, meshing with the worm, (e) an extending pin coupled to the worm gear, wherein rotational movement of the motor output shaft causes arcuate movement of the extending pin between at least two operating positions;

(f) a link having a first end and a second end, wherein the first end is pivotably coupled to the manual locking lever;

(g) a slot in the second end of the link, the slot having two slot ends connected by two parallel sides, wherein the slot engages the extending pin and allows limited relative substantially linear movement of the link with respect to the pin and wherein the combination of the slot and the pin constrain the link to at least some linear movement in response to arcuate movement of the extending pin, wherein, in at least one of the operating positions, the combination of the link, slot, extending pin, worm gear and worm hold the manual locking lever in the locked position so that external force on the manual locking lever does not move the manual locking lever from the locked position.

2. The locking actuator system of claim 1, wherein in the other of the operating positions, the slot and extending pin allow linear movement of the link, in turn allowing the manual locking lever to be movable between the locked and the unlocked positions.

3. The locking actuator system of claim 1, wherein the extending pin is mounted to a rotary arm that is coupled to the worm gear, wherein, as the worm gear rotates, the rotary arm moves in an arcuate position.

4. The locking actuator system of claim 3, wherein the rotary arm and extending pin are mounted exterior the housing.

5. The locking actuator system of claim 1, also comprising a mechanical stop mounted on the housing, limiting the arcuate movement of the extending pin, wherein, when the electric motor is driven in one direction, the extending pin moves in a first arcuate direction until the mechanical stop stops movement of the extending pin in one of the operating positions.

6. The locking actuator system of claim 5, wherein, when the electric motor is driven in the other direction, the extending pin moves in a second arcuate direction until the mechanical stop stops movement of the extending pin in the other of the operating positions.

* * * * *